United States Patent [19]
Crisci
[11] 4,230,229
[45] Oct. 28, 1980

[54] SNAP ON BOTTLE CAP

[75] Inventor: Harry Crisci, New Castle, Pa.
[73] Assignee: Northern Engineering & Plastics Corporation, New Castle, Pa.

[21] Appl. No.: 13,269
[22] Filed: Feb. 21, 1979

Related U.S. Application Data

[63] Continuation-in-part of Ser. No. 967,390, Dec. 7, 1978.

[51] Int. Cl.³ ..... B65D 41/48
[52] U.S. Cl. ..... 215/253; 215/295; 215/320
[58] Field of Search ..... 215/253, 370, 295, 306, 215/305, 320; 220/375

[56] References Cited

U.S. PATENT DOCUMENTS

| | | | |
|---|---|---|---|
| 1,293,969 | 2/1919 | Steinhauser | 215/305 |
| 2,669,369 | 2/1954 | Towns | 215/305 |
| 3,341,046 | 9/1967 | Bereziat et al. | 215/253 X |
| 3,411,652 | 11/1968 | Shuffrey et al. | 215/320 |
| 3,462,035 | 8/1969 | Grussen | 215/253 |
| 3,572,413 | 3/1971 | Livingstone | 215/320 X |
| 3,589,543 | 6/1971 | Weigand | 215/253 |
| 3,592,349 | 7/1971 | Baugh | 215/320 X |
| 3,653,529 | 4/1972 | Segmuller | 215/305 X |
| 3,858,742 | 1/1975 | Grussen | 215/320 X |
| 3,865,268 | 2/1975 | Coop | 215/253 |
| 3,872,993 | 3/1975 | Aichinger | 215/320 |
| 4,073,399 | 2/1978 | Lewis | 215/253 |
| 4,090,630 | 5/1978 | Wiedmer | 215/320 |

*Primary Examiner*—Allan N. Shoap
*Attorney, Agent, or Firm*—Webster B. Harpman

[57] ABSTRACT

A snap on bottle cap for a container having a neck configuration including an annular shoulder over which the bottle cap is engaged so as to be self-retaining thereon. The bottle cap is formed of resilient material permitting distortion of the cap when it is applied to the bottle. A ring is positioned around and fastened to an annular flange of the cap by a plurality of frangible elements and it is attached to a portion thereof separated from the remainder by spaced cutaway areas. The ring thus may be used as a pull ring to free the portion of the annular flange as necessary in removing the cap by permitting the remainder of the cap to expand circumferentially so as to become disengaged from the annular shoulder on the neck portion of the bottle. The separation of the ring provides a visual indication of tampering.

5 Claims, 5 Drawing Figures

SNAP ON BOTTLE CAP

This application is a continuation-in-part of application Ser. No. 967,390, filed Dec. 7, 1978.

BACKGROUND OF THE INVENTION (1) Field of the Invention

This invention relates to bottle caps as used on milk bottles and the like wherein a separable portion of the cap indicates tampering with the cap so that the purchaser may be assured that the contents of the bottle are as originally packed.

(2) Description of the Prior Art

Snap on bottle caps as heretofore proposed may be seen in U.S. Pat. Nos. 3,411,652; 3,572,413; 3,592,349; 3,872,933 and 4,090,630.

In each of the foregoing disclosures bottle caps are disclosed which theoretically are self-retaining on an appropriately shaped neck of a container such as a bottle. The inherent problem which such devices in the difficulty of removing them if they are formed of a material that is sufficiently rigid to keep the cap in position on the bottle in a liquid tight manner and alternately the leakage of the contents of the bottles if the caps are formed of a flexible material which would facilitate their removal.

Additionally no indication of tampering with or previous removal and replacement of the caps is provided. Attempts have been made to overcome these difficulties and in U.S. Pat. Nos. 3,462,035, reissue 27,648; 3,940,004 and 4,037,746, tear strips or portions facilitating the removal of the cap from the container are provided. The problems with such devices is primarily the difficulty in applying the caps to the containers as the unusual configurations of the tear strips or attachments makes the caps difficult to handle by the automatic equiment which is used in applying the caps to the containers such as milk bottles or the like.

Still further proposals have been made to tear away a portion of an annular flange or skirt on a bottle cap so as to destroy the portions thereof that engages and secures the cap in closed position on the neck of a container. Such devices may be seen in U.S. Pat. Nos. 3,120,900; 3,338,446 and 3,392,862.

The present invention overcomes the several difficulties experienced with the prior art bottle caps by providing a relatively small cap of resilient material in a form that will be self-retaining when snapped into position on a bottle having a neck configuration including an out-turned annular shoulder and which may be relatively easily removed by separating most of an annular reinforcing ring from the cap to form a full ring attached to a portion of the annular flange of the cap which permits the circumference of the cap to be expanded so as to free the same from the shoulder on the bottle and at the same time to provide a tell-tale indication that the cap has been removed and/or replaced.

SUMMARY OF THE INVENTION

Milk bottles of the one gallon or half gallon size blow molded of resilient flexible plastic material employing flexible plastic bottle caps threadably engaged thereon have become widely used in distributing milk because of the advantages of one time use packaging and the desirability of readily indicating to the final consumer the uncontaminated, unopened bottle. A typical prior art tamper proof bottle cap may be seen in my U.S. Pat. No. 3,504,818.

The present invention forms the bottle cap of a resilient material in a shape and configuration that may be easily and quickly applied to a milk bottle having a neck configuration with an annular shoulder thereon by simply pushing it downwardly thereon. The bottle cap is distorted in the application to the bottle and becomes self-retaining and provides dual sealing areas to insure a liquid tight closure. A ring having a reinforced lower edge is secured to the annular flange of the cap by a pluralityof frangible elements spaced circumferentially thereon. The annular flange has a pair of vertical slots defining the portion of the annular flange that is attached to the ring. The ring can be grasped manually and separated from the remainder of the cap so as to deform and lift the attached portion of the annular flange permitting the same to expand circumferentially and radially so that the cap is conveniently and easily removed. Attempts to remove the cap are thus visually indicated.

DESCRIPTION OF THE PREFERRED EMBODIMENT

Figure 1:
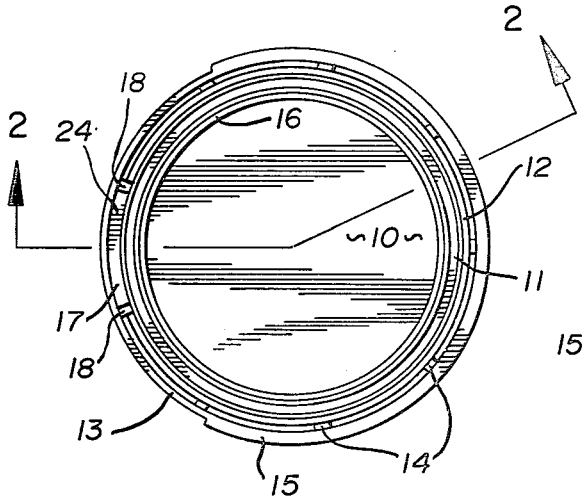
FIG. 1 is a bottom elevation of the bottle cap.
Figure 2:
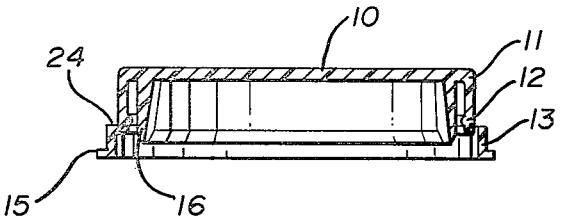
FIG. 2 is a cross section on lines 2—2 of FIG. 1.
Figure 4:
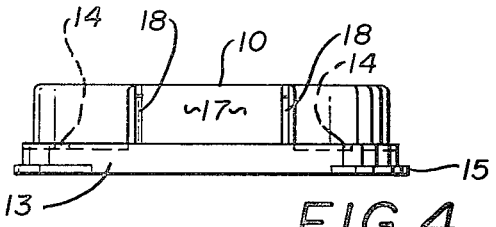
FIG. 4 is a side elevation of the bottle cap.

In its illustrated form the bottle cap as seen in FIGS. 1,2 and 4 of the drawings comprises a top portion 10 having a depending annular flange 11 on its peripheral edge. An annular rib 12 is formed on the inner surface of the flange 11 adjacent its lowermost edge. A ring 13 is affixed to the outer surface of the annular flange 11 by a plurality of frangible elements 14. An outturned right angular secondary flange 15 is formed on the outer lowermost surface of said annular ring 13 and extends around a substantial portion thereof. A relatively thin cross sectionally tapered downturned annular flange 16 is formed on the top portion 10 and is of a diameter smaller than the diameter of the annular flange 11 and thus spaced with respect thereto and with respect to the inner surface of the annular rib 12. A portion 17 of the annular flange 11 is separated from the remainder by a pair of vertical slots 18 as best seen in FIG. 4 of the drawings. The portion 17 becomes a hinge. The ring 13 forms a manually movable device that may be conveniently grasped and separated from the cap. The secondary flange 15 formed on most of the ring 13 acts as a reinforcing member applying additional rigidity and shape retention to the ring 13 which is transferred to the annular flange 15 to provide the necessary strength and resiliency which makes the bottle cap self retaining on the neck of the bottle by holding said portion 17 of the annular flange 11 in closed position until the ringe 13 is removed from the rest of the flange 11.

Figure 3:
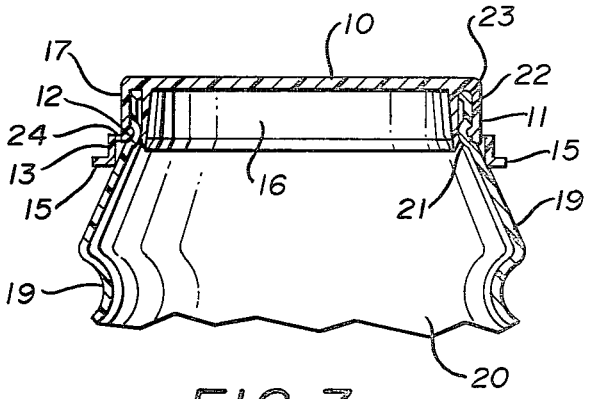
FIG. 3 is a cross section similar to FIG. 2 showing the cap engaged on the neck portion of a bottle.

In FIG. 3 of the drawings, the neck portion 19 of a bottle, generally indicated at 20, most of which is broken away, is illustrated in cross section and it will be observed that the finish of the neck 19 of the bottle 20 has an annular inner rib 21 from which an annular flange which is U-shaped in cross section extends. The annular flange includes a vertical section 22 and an inturned horizontal section 23 with the result that the innermost portion of the inturned section 23 and the inner portion of the rib-like configuration 21 form vertically spaced smooth surfaces of the finish neck configuration against which the secondary flange 16 of the cap of the invention will register to form dual liquid tight seals in addition to the seals obtained between the outer surface of the annular flange 22 of the U-shaped neck finish and the inner surface of the annular flange 11 of the bottle cap.

Figure 5:
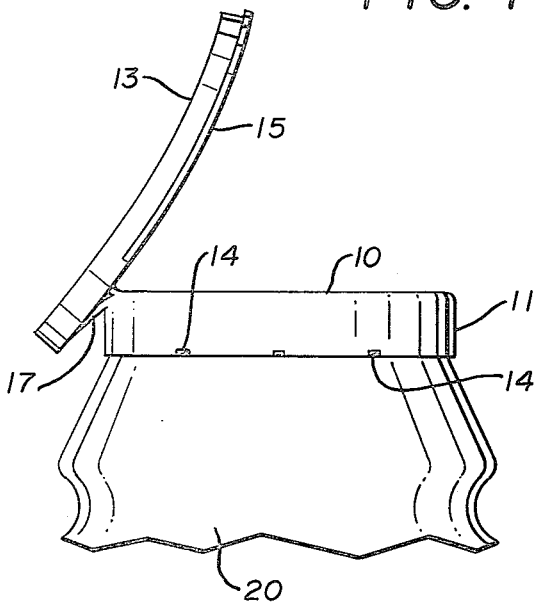
FIG. 5 is a side elevation of a portion of the bottle showing the bottle cap partially removed therefrom.

In FIG. 3 of the drawings, the bottle cap of the invention is shown in position on the neck finish of the bottle 20 with the portion 17 of the annular flange in its normal position, reinforced by the ring 13 while in FIG. 5 of the drawings the portion 17 is shown in the position is assumes when it is separated from the remainder of the annular flange 11 of the cap as by lifting it with the ring 13 so as to permit the major portion of the annular flange 11 and particularly the annular rib 12 therein to become enlarged as necessary in freeing the bottle cap from the bottle neck.

By referring to FIG. 5 of the drawings, it wll be seen that most of the ring 13 has been separated from the annular flange 11 by manually breaking the frangible elements 14 forming a pull ring attached to the portion 17 of the annular flange 11 through its connecting area 24 which may also be seen in FIGS. 1, 2, and 3 of the drawings. It will be observed that the thin frangible elements 14 are positioned so as to join the ring 13 to the annular flange 11 at evenly spaced locations.

The bottle cap disclosed herein may be easily applied to bottles by conventional capping machines.

Although but one embodiment of the present invention has been illustrated and described, it will be apparent to those skilled in the art that various changes and modifications may be made therein without departing from the spirit of the invention and having thus described my invention what I claim is:

1. A resilient deformable cap comprising a planar top, an annular flange depending from the peripheral edge of the top and having a lower peripheral edge, an annular rib on the inner surface of said annular flange, a reinforcing ring positioned in closely spaced relation to and around the outer surface of said annular flange, said ring having a bottom peripheral edge located beneath said annular flange lower peripheral edge, a vertical hinge portion in said annular flange, said hinge portion beng defined by a pair of circumferentially spaced vertical slots defined in said annular flange and extending from said top peripheral edge to said annular flange lower peripheral edge so that said hinge portion is flexible radially outwardly of said annular flange, a portion of said reinforcing ring being integrally attached to said annular flange at said hinge portion and a plurality of circumferentially spaced frangible elements closely connecting the remainder of said reinforcing ring with the remainder of said annular flange, said hinge portion of said annular flange being normally held in position to be in circumferential alignment with the remainder of said annular flange by said reinforcing ring, said hinge portion of said annular flange being deformable by movement of said reinforcing ring so that moving said reinforcing ring to break said frangible elements deforms said hinge portion outwardly and upwardly of said annular flange so that said deformed hinge portion in combination with said reinforcing ring forms a fulcrum of a pull tab upon which pulling force is exerted via said reinforcing ring, said hinge portion and said planar top remaining intact the remainder of said annular flange being permitted to expand radially outward under the influence of said pulling force being exerted thereon via said pull tab.

2. The cap set forth in claim 1 and wherein said portion of said reinforcing ring is attached to the edge of said annular flange.

3. The cap set forth in claim 1 and wherein said annular flange is cross-sectionally tapered with its area of greatest thickness adjoining said top.

4. The cap set forth in claim 1 and wherein said spaced vertical slots in said annular flange are spaced with respect to one another a distance substantially one-eighth of the circumference of said annular flange.

5. The cap set forth in claim 1 and wherein an outturned right angular flange is formed on the reinforcing ring in an area thereof spaced with respect to said attached portion.

* * * * *